US012359435B2

(12) United States Patent
Valentz et al.

(10) Patent No.: US 12,359,435 B2
(45) Date of Patent: Jul. 15, 2025

(54) SKYLIGHT FRAME WITH DRAIN NOTCHES

(71) Applicant: V Tech Industries, L.P., Houston, TX (US)

(72) Inventors: Arthur J. Valentz, Sugar Land, TX (US); John E. Nemazi, Bloomfield Hills, MI (US)

(73) Assignee: Tech Industries, L.P., Houston, TX (US)

( * ) Notice: Subject to any disclaimer, the term of this patent is extended or adjusted under 35 U.S.C. 154(b) by 37 days.

(21) Appl. No.: 18/062,684

(22) Filed: Dec. 7, 2022

(65) Prior Publication Data

US 2024/0191506 A1 Jun. 13, 2024

(51) Int. Cl.
*E04D 13/03* (2006.01)

(52) U.S. Cl.
CPC ..... *E04D 13/031* (2013.01)

(58) Field of Classification Search
CPC ... E04D 13/03; E04D 13/031; E04D 13/0315; E04D 13/0325
See application file for complete search history.

(56) References Cited

U.S. PATENT DOCUMENTS 3,983,669 A * 10/1976 Bogaert ..... E04D 13/0315 52/200
5,094,040 A * 3/1992 Bunka ..... E04D 13/031 52/22
7,296,388 B2 * 11/2007 Valentz ..... E04D 13/0315 52/203
7,762,028 B2 * 7/2010 Valentz ..... E04D 13/0315 52/204.5
9,874,018 B1 1/2018 Conklin
9,920,532 B1 * 3/2018 Conklin ..... E06B 3/66
2005/0000173 A1 * 1/2005 Lindgren ..... E06B 7/2301 52/200
2005/0055901 A1 * 3/2005 Valentz ..... E04D 13/0305 52/200
2006/0150542 A1 * 7/2006 Brinton ..... E04D 13/031 52/200
2007/0180789 A1 * 8/2007 Valentz ..... E04D 13/03 52/200

(Continued)

FOREIGN PATENT DOCUMENTS

CA 1201264 A 3/1986
JP H06246782 A 9/1994
JP 2013120772 A 6/2013

OTHER PUBLICATIONS

International Search report for PCT/US2023/037068, prepared by the United States Patent and Trademark Office, mailing date Jan. 29, 2024, 2 pages.

*Primary Examiner* — Christine T Cajilig
(74) *Attorney, Agent, or Firm* — Brooks Kushman P.C.

(57) ABSTRACT

A skylight having a frame with a flanged lip about a skylight window unit periphery having water drainage notches formed therein help keep the windows clean. The notches in the frame flange radiates outward from a central light transmissive region of the window unit and have an inboard depth adjacent the window opening approximately equal to the flange thickness. Inclination of the skylight when installed allows water to freely drain from through the notches off the central light transmissive region of the window unit.

17 Claims, 5 Drawing Sheets

(56) References Cited

U.S. PATENT DOCUMENTS

2008/0184635 A1* 8/2008 Nemazi ..... B29C 70/76
52/204.5
2019/0323283 A1* 10/2019 Nielsen ..... E06B 3/6715

* cited by examiner

SKYLIGHT FRAME WITH DRAIN NOTCHES

TECHNICAL FIELD

The present invention relates to skylights having a glass window unit held in a peripheral frame.

BACKGROUND

Skylights are typically mounted on a roof top in an inclined position. Rain and debris failing on the window unit wash off. Skylights are typically formed of window unit, a light transparent panel of glass or plastic, mounted in a peripheral frame formed of wood, metal or plastic. Most skylight have a peripheral frame which grips the upper and lower side of the window unit. The upper edge of the frame forms a small flange lip covering glass adjacent the edge creating dam which prevents all of the water from draining off the window. This water tends to evaporate leaving a dirty window surface.

To avoid forming water dams some skylights have flush mounted the window glass without a raised lip as shown in U.S. Pat. No. 9,874,018. Flush mount glass relies on an adhesive to retain the glass to the frame. Another example of flush mounted glass is shown is U.S. Pat. No. 7,296,388 along with flange mounted embodiments. In U.S. Pat. No. 7,296,388 the frame is formed in situ by a reaction injection molding process. U.S. Pat. No. 7,296,388 is incorporated by reference in its entirety, to disclose a process for forming a window containing assembly with a reaction injection molded plastic frame. Several embodiments provide a peripheral polymeric frame molded about a multi-layer light transparent panel of glass or plastic.

SUMMARY

It is an object of the present invention to manufacture skylights having a frame with a flanged lip about skylight window periphery having water drainage notches formed therein help keep the windows clean. The notches in the frame flange radiate outward from the window opening and have a depth adjacent the opening approximately equal to the flange thickness. Inclination of the skylight when installed allows water to freely drain from through the notches off the central light transmissive region of the window unit.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1A:
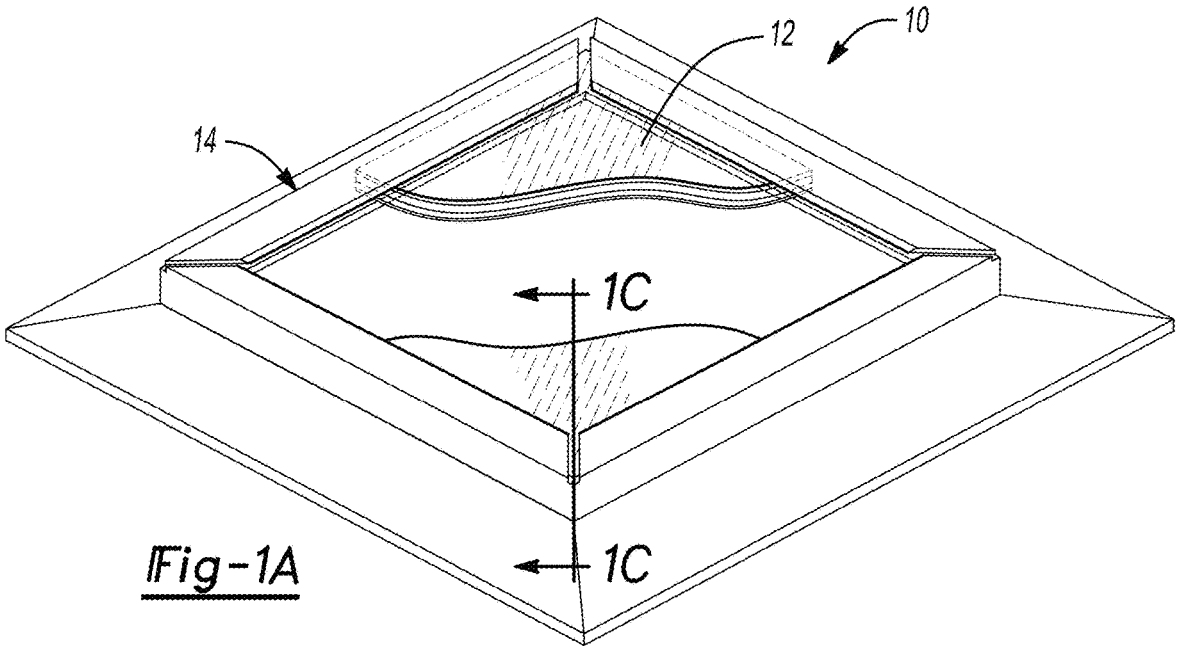
FIG. 1A is a perspective view of a first skylight embodiment of the invention.
Figure 1B:
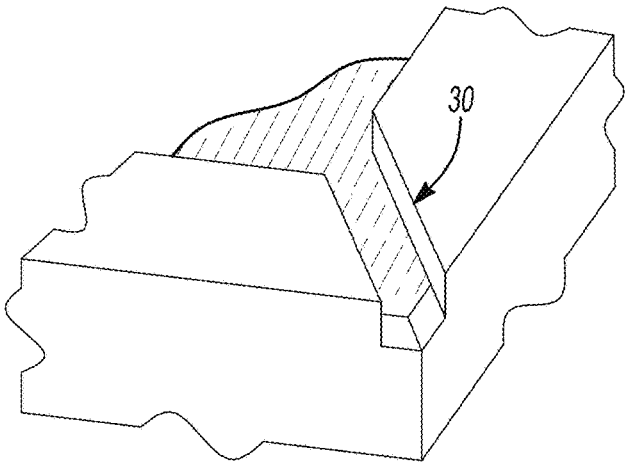
FIG. 1B is an enlarged perspective view of a portion of FIG. 1A.
Figure 1C:
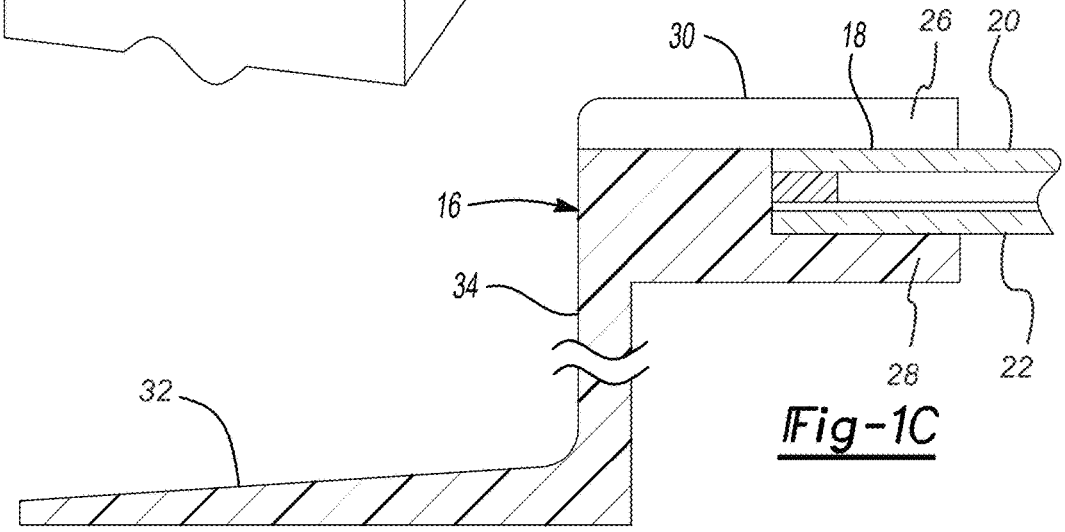
FIG. 1C is a section view taken along line 1C-1C in FIG. 1A.

FIG. 1 is a perspective view of a first skylight embodiment 10 having a central transparent window unit 12 and a frame assembly 14. The frame assembly 14 has a peripheral frame portion 16 mounted to a peripheral border region 18 of the window unit inboard of the window peripheral edge. The peripheral border region 18 of the glass has an outward and inward faces 20 and 22 sized larger than the window opening 24, forming a central light transmissive region within the outer peripheral boarder region 18.

The frame 16 has upper and lower overlapping regions 26 and 28 engaging the outward and inward faces 20 and 22 of the glass outer boarder 18 which extends about the window opening. The frame upper overlapping region has a at least one notch 30 formed therein extending outward from the window opening to allow water and debris to drain off the central light transmissive region of the window unit when the skylight in an inclined position. Notches can be located in the corners and or along the straight sides of a rectangular skylight.

The notches 30 in the frame upper overlapping region radiate outward from the window opening and have a depth adjacent the opening approximately equal to the thickness of flange formed by the overlapping region. The notches are 0.75-0.25 inches and preferably about 0.5 inches wide. Inclination of the skylight when installed allows water to freely drain from through the notches 30 off the central light transmissive region of the window unit 12.

Window unit 12 is an insulated glass unit with two layers of glass separated by a peripheral spacer tapping gas therebetween. Preferably the inner glass sheet is an made of laminated glass to provide extra strength and to maintain in place even when the glass shatters providing fall resistance and excess wind load protection.

In FIG. 1 has a notch with a straight square cross section constant width and depth shape. The notches are 0.75-0.25 inches wide and preferably about 0.5 inches wide. Notch 30 extend all the way to the widow unit surface. However, other notch shapes can be used. The notch can have a non-rectangular cross-section, decrease in depth as it moves away from the window opening or vary on slot width. The notch need not be square in section but could develop semi-circular profile as it moves away from the glass.

FIG. 1 illustrates a curb style frame assemble 14. Peripheral frame portion 16 is mounted on an internally formed raised curb 32 with a surrounding flange skirt 34. Curb 32 raises the window unit above snow a water on the roof. Flange skirt 34 can extend below the roof shingles or roofing membrane to keep water out.

Figure 2A:
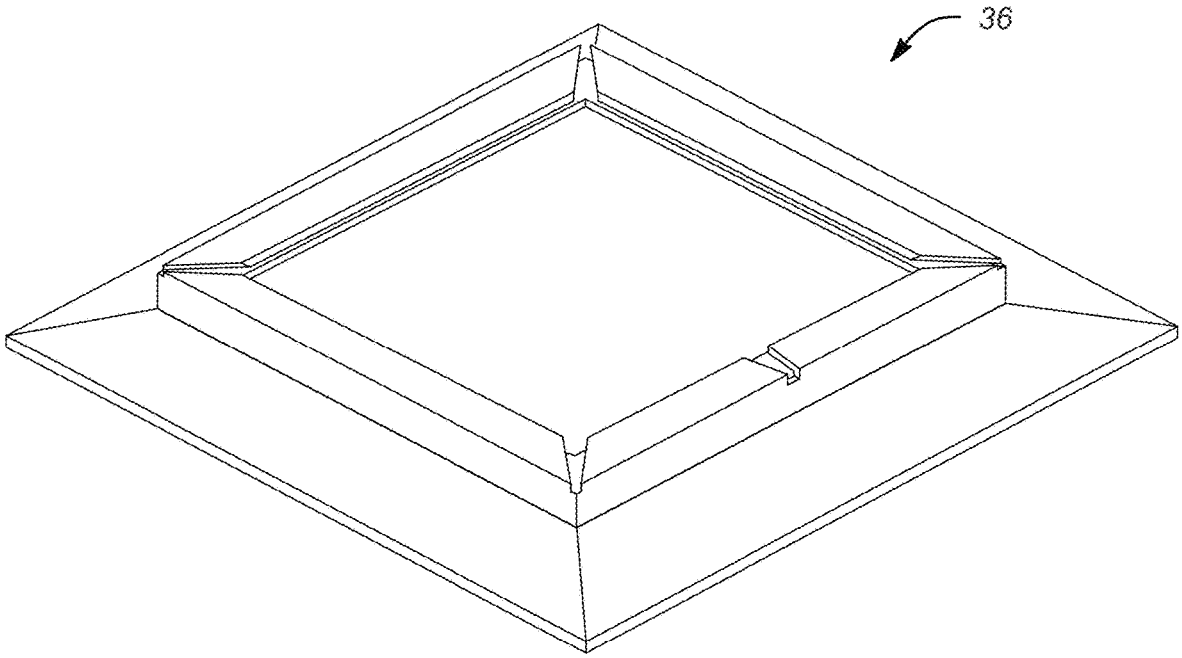
FIG. 2A is a perspective view of a second skylight embodiment of the invention.
Figure 2B:
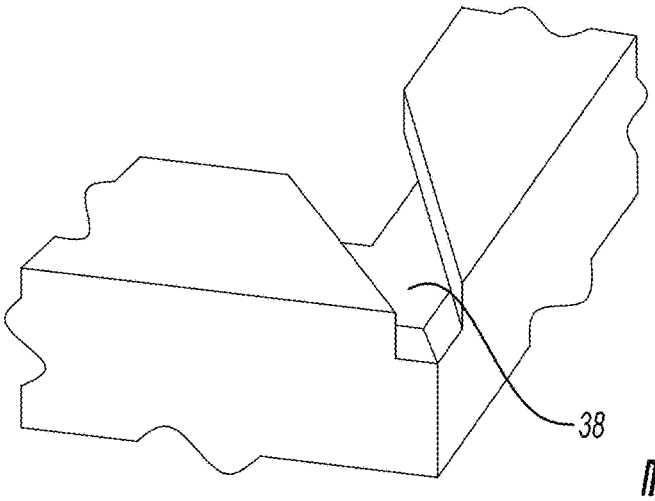
FIG. 2B is an enlarged perspective view of a portion of FIG. 2A.

FIGS. 2A and 2B illustrate a second embodiment skylight 36 with a curb style frame and an alternative notch shape 38. The notch increases in width as it extends away from the window opening 24. Notches can be located in the corner of a rectangular skylight or along the straight frame sides of rectangular as shown in FIG. 2A.

Figure 3A:
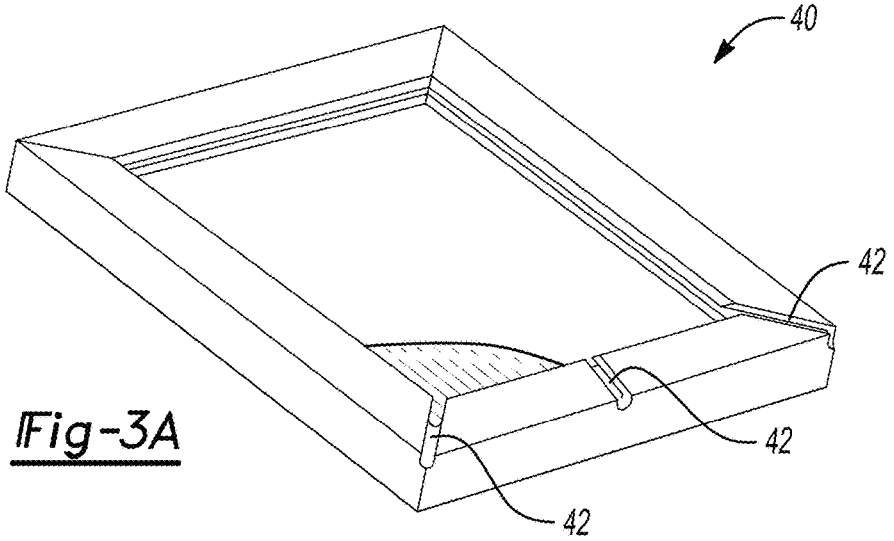
FIG. 3A is a perspective view of a third skylight embodiment of the invention.
Figure 3B:
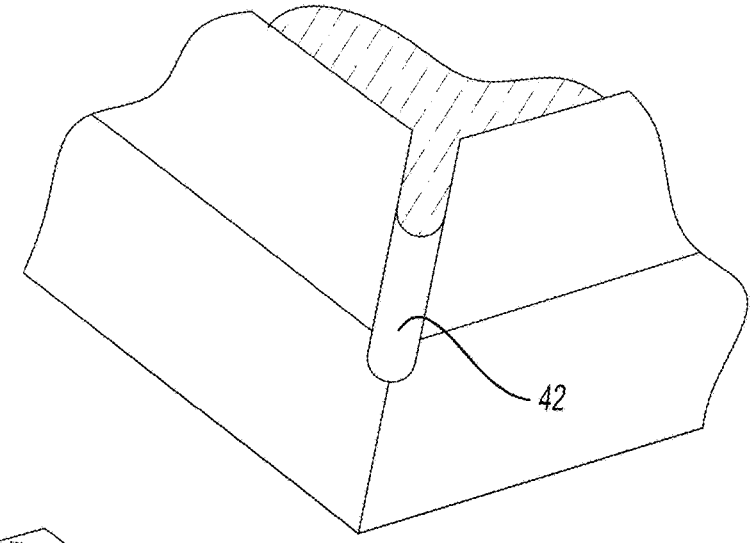
FIG. 3B is an enlarged perspective view of a portion of FIG. 3A.

FIG. 3 illustrate a cap style skylight 40 having a plurality of notches 42 in the corners of a rectangular skylight and along the straight frame sides. Notches 42 in a cap style light can be semicircular in cross-section or rectangular as show in the other embodiments.

Figure 4A:
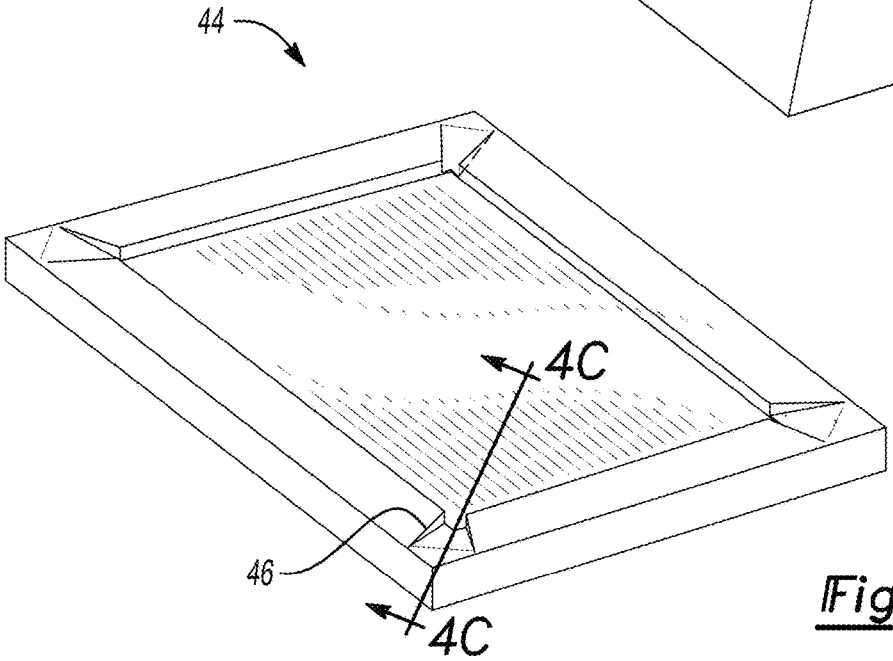
FIG. 4A is a perspective view of a four skylight embodiment of the invention.
Figure 4B:
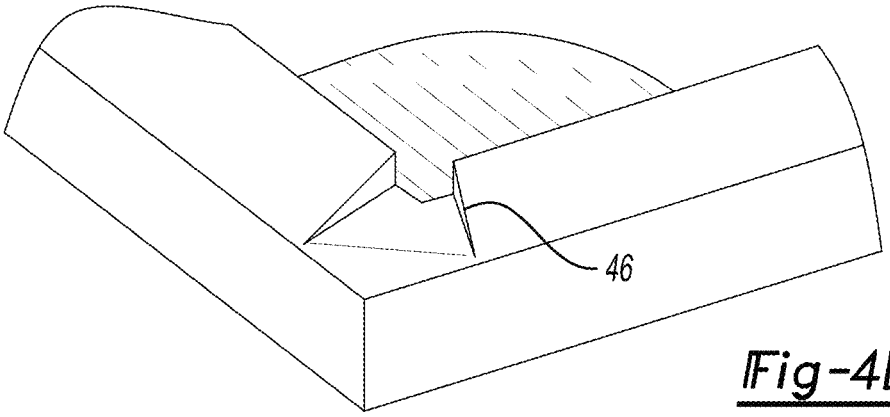
FIG. 4B is an enlarged perspective view of a portion of FIG. 4A.
Figure 4C:
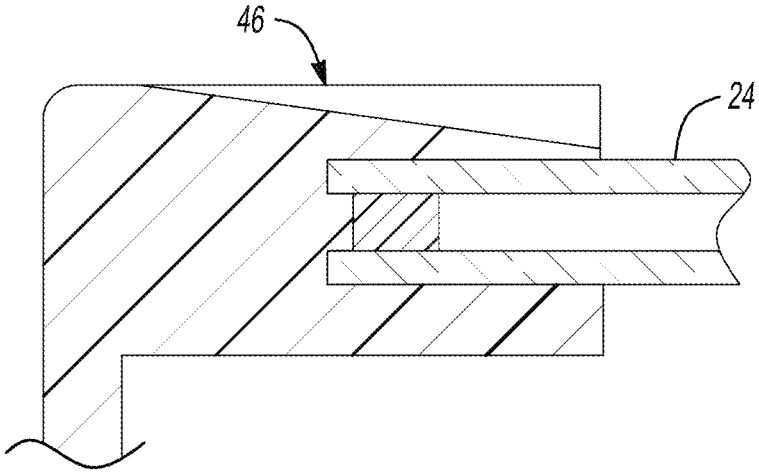
FIG. 4C is a section view taken along line 4C-4C in FIG. 4A.

FIG. 4A-4C illustrates a fourth embodiment 44 showing a cap style skylight having a different notch shape. Variable depth notch 46 is approximately flush with the glass where it meets window opening 24 and becomes progressively shallower as it extends outward until it has zero depth, as shown in FIG. 4B-4C. The angle of the floor of the notch is less the 15 degrees relative to the glass and preferably less than 12 degrees. The sides of notch 46 also becomes progressively wider as it extends outwardly, as shown in FIG. 4B. The notch 46 can be located in the corner or in the frame rail.

Figure 5:
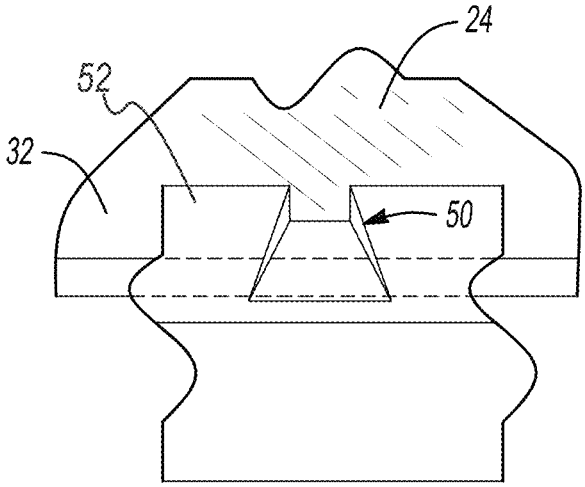
FIG. 5 is a perspective view of an alternative notch embodiment of the invention.

FIG. 5 illustrates an alternative notch configuration 50 which is narrower at its inboard end adjacent the window opening 24 and diverges as it extends away therefrom. The notch 50 in the frame portion 52 also becomes shallower as it extends away from the window opening until it reaches zero depth to allow water and debris to drain off the central light transmissive region of the window unit when the skylight in an inclined position.

Figure 6:
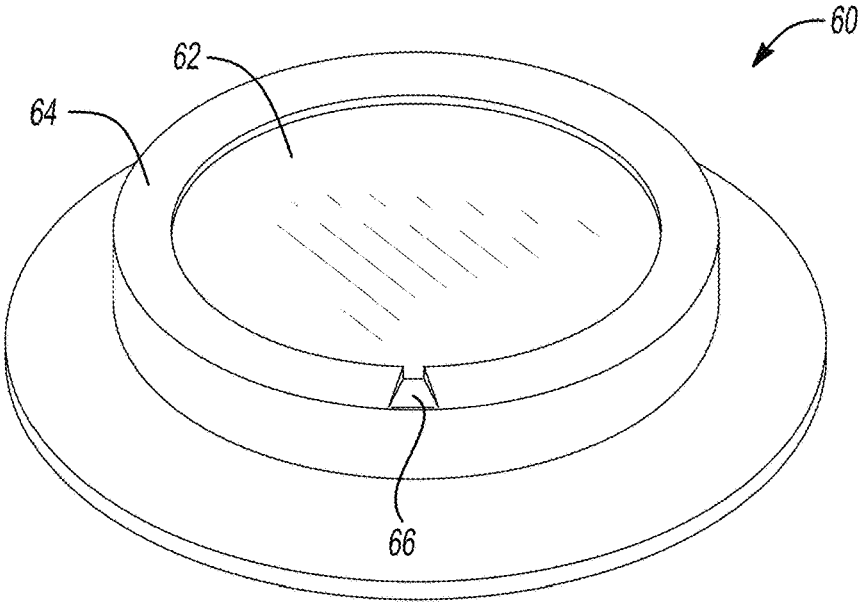
FIG. 6 is a perspective view of a fifth skylight embodiment of the invention.

FIG. 6 illustrates a circular skylight 60 for mounting on an inclined roof. The skylight has a circular glass window unit 62 with a circular frame 64. The frame has at least one notch 66 formed therein to allow water and debris to drain off the central light transmissive region of the window unit. During installation, the frame is positioned with the notch 66 located downhill to allow water and debris to drain, keeping the glass clean.

Figure 7:
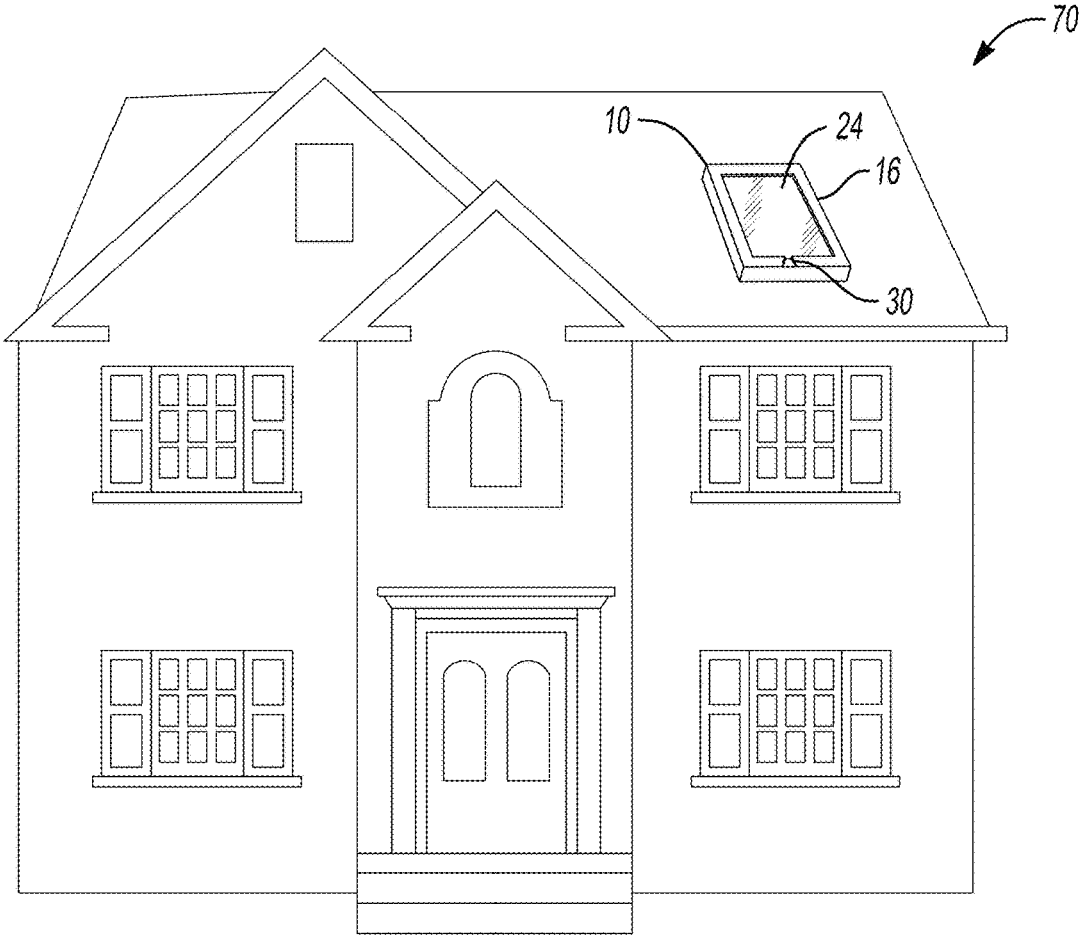
FIG. 7 is a perspective view of a skylight assembly installed in a building.

FIG. 7 depicts a building 70 with a skylight 10 mounted on the roof in an inclined position. Notches 30 in the skylight peripheral frame portion 16 allow water to completely leave the surface of the window opening 24 keeping the glass clean.

While the frame can be formed with a variety of material and forming methods, it is preferred that the frame is formed of reaction injected molded aliphatic polyurethane described in U.S. Pat. No. 7,296,388 previously is incorporated by reference. The material can be UV stable, so the skylight frame does not need to be painted and can last over 20 years in direct sunlight. The notches in the frame can be molded-in-place when the frame is molded about the glass window unit.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A skylight comprising:

a frame formed of reaction injected molded aliphatic polyurethane having an upper overlapping region, a lower overlapping region, and a peripheral edge, with a window opening formed therethrough;

an insulated glass window unit having outward and inward faces sized larger than the window opening, the window unit having a central light transmissive region and an outer border region; and wherein the frame is reaction injected molded about the window unit with the upper overlapping region and the lower overlapping region bonded to the outward and inward faces of the outer border region which extends about the window opening; and wherein an outboard overlapping region of the frame is provided with at least one notch in the upper overlapping region extending outward from the window opening to allow water and debris to drain off the central light transmissive region of the window unit when the skylight in an inclined position.

2. The skylight of claim 1, wherein the at least one notch has a width which diverges as it extends outward from the window opening to minimize accumulation of debris.

3. The skylight of claim 1, wherein the at least one notch comprises a plurality of spaced apart notches.

4. The skylight of claim 1, further comprising a primer applied to the outer border region of outward and inward faces of the window unit.

5. The skylight of claim 1, wherein the skylight is rectangular in shape with at least one notch located midway between two adjacent corners of a lower edge of the frame when the skylight is in an inclined position.

6. The skylight of claim 1, wherein the skylight is rectangular in shape with notches located in at least two adjacent corners of the frame.

7. The skylight of claim 1, wherein the at least one notch in the outboard overlapping region of the frame has a depth approximately equal to the thickness of the outboard overlapping region.

8. The skylight of claim 1, wherein the skylight is rectangular in shape with notches located each of the corners of the frame.

9. The skylight of claim 1, wherein the at least one notch has a depth where it meets the central light transmissive region of the window unit approximately equal to the thickness of the outboard overlapping region.

10. The skylight of claim 9, wherein the depth of the at least one notch becomes shallower as it extends away from the central light transmissive region.

11. A skylight comprising:

a frame formed of reaction injected molded aliphatic polyurethane having an upper overlapping region, a lower overlapping region, and a peripheral edge, with a window opening formed therethrough;

a glass window having outward and inward faces sized larger than the window opening, the window having a central light transmissive region and an outer border region; and wherein the frame is reaction injected molded about the window with the upper overlapping region and the lower overlapping region bonded to the outward and inward faces of the outer border region which extends about the window opening; and wherein an outboard overlapping region of the frame is provided with plurality of spaced apart notches in the upper overlapping region extending outward from the window opening with a depth where they meet the central light transmissive region approximately equal to the thickness of the outboard overlapping region, to allow water and debris to drain off the central light transmissive region when the skylight is in an inclined position.

12. The skylight of claim 11, wherein each notch has a width which diverges as it extends outward from the window opening to minimize accumulation of debris.

13. The skylight of claim 11, wherein the depth of wherein each notch becomes shallower as it extends away from the central light transmissive region.

14. A skylight comprising:

a frame encircling a window opening, the frame having an upper overlapping region, a lower overlapping region, and an inner peripheral edge;

an insulated glass window unit having outward and inward faces sized larger than the window opening, the window unit having a central light transmissive region and an outer border region with outward and inward faces; and wherein the outward and inward regions of the frame have the upper overlapping region and the lower overlapping region engaging outward and inward sides of the outer border regions which extends about the window opening; and wherein an outboard overlapping region of the frame are provided with at least one notch in the upper overlapping region extending outward from the window opening, with the depth of the at least one notch becoming shallower as it extends away from the central light transmissive region to allow water and debris to drain off the central light transmissive region of the window unit when the skylight in an inclined position.

15. The skylight of claim 14, wherein the frame is made of a reaction injected molded aliphatic polyurethane formed in situ about the insulated glass window unit.

16. The skylight of claim 15, wherein the at least one notch is molded into the frame when the frame is made.

17. The skylight of claim 16, wherein the depth of the at least one notch becomes shallower as it extends away from the central light transmissive region.

* * * * *